US006318312B1

(12) United States Patent
Bauer et al.

(10) Patent No.: US 6,318,312 B1
(45) Date of Patent: Nov. 20, 2001

(54) PROCEDURE FOR COOLING ELECTROMAGNETIC ACTUATORS FOR INTERNAL COMBUSTION ENGINE VALVES

(75) Inventors: Erwin Bauer, Regensburg; Wolfram Bohne, Kirchseeon; Albert Hoerl-Liegl, Ottenhofen; Ferdinand Loebbering, Alteglofsheim, all of (DE)

(73) Assignee: Siemens Aktiengesellschaft (DE)

( * ) Notice: Subject to any disclaimer, the term of this patent is extended or adjusted under 35 U.S.C. 154(b) by 0 days.

(21) Appl. No.: 09/592,543

(22) Filed: Jun. 12, 2000

(30) Foreign Application Priority Data

Jun. 10, 1999 (DE) ..... 199 26 412

(51) Int. Cl.[7] ..... F01L 9/04; F01P 3/14

(52) U.S. Cl. ..... 123/90.11; 251/129.1; 251/129.15

(58) Field of Search ..... 123/90.11, 41.01; 251/129.01, 129.1, 129.15

(56) References Cited

U.S. PATENT DOCUMENTS 3,882,833 5/1975 Longstaff et al. ..... 123/90.11
5,875,746 * 3/1999 Izuo ..... 123/90.11
6,089,196 * 7/2000 Izuo et al. ..... 123/90.11

FOREIGN PATENT DOCUMENTS 197 14 496 A 1 10/1998 (DE) .

* cited by examiner

*Primary Examiner*—Weilun Lo

(57) ABSTRACT

A method and device for cooling an electromagnetic actuator device of an internal combustion engine valves. A fluid stream circulating in the internal combustion engine, especially a lubricating oil stream, is passed through each electromagnetic actuator device to cool the actuator. The amount of the fluid stream passed through the actuator is variable and is adjusted by a suitable valve arrangement in such a way that a critical component temperature of the actuators is not exceeded. An electrical actuator parameter, such as the current flowing through the coils of the actuator, which corresponds to the component's temperature is determined in an electronic control unit associated with the actuators, and is compared in the electronic control unit with the critical component temperature or a corresponding critical electrical parameter. The electronic control unit controls the valve arrangement to provide the required stream of cooling fluid.

14 Claims, 2 Drawing Sheets

PROCEDURE FOR COOLING ELECTROMAGNETIC ACTUATORS FOR INTERNAL COMBUSTION ENGINE VALVES

CROSS REFERENCE TO RELATED APPLICATIONS

This application claims the benefit of priority based on German Application No. 19926412.0, filed Jun. 10, 1999, which is incorporated by reference herein in its entirety.

BACKGROUND OF THE INVENTION

The invention relates to a procedure for cooling electromagnetic actuating devices for internal combustion engine valves in which some of a fluid circulating in the internal combustion engine, particularly lubricating oil, is passed through each electromagnetic actuating device (i.e., an actuator).

An electromagnetic valve actuator for an internal combustion engine has immense advantages because of the freedom with respect to the valve control times, i.e., with respect to the pertinent opening and closing points of the valve. However, relatively high forces must be applied for actuation, especially for opening the valve, which necessitates a certain minimum coil and armature size. As a result, it is extremely difficult to accommodate a conventional actuator housing in a modern cylinder head of an internal combustion engine that, for example, drives a motor vehicle. Additionally, when the valves are actuated, a relatively large amount of heat develops in the coils, especially at higher actuation frequencies, which has to be dissipated in a suitable way.

Pure convection cooling of the actuator housing in the surrounding air is insufficient for this purpose, especially when the constricted space conditions just described are taken into account.

German Patent No. 197 14 496 A1 discloses a conventional electromagnetic valve actuator that is fluid cooled. In particular, a cooling channel is provided in an actuator housing through which some of the stream of fluid circulating inside the internal combustion engine is passed as a cooling fluid. This cooling fluid stream may be provided by engine coolant fluid (e.g., the liquid coolant of a liquid-cooled internal combustion engine) or may be derived from the lubricating oil stream of the internal combustion engine. Alternatively, as disclosed in U.S. Pat. No. 3,882,833, the cooling fluid stream may also be passed directly through the actuator, as opposed to passing through cooling channels integrated in an actuator housing.

A percentage of the power developed by the internal combustion engine is lost to circulating the cooling fluid to the actuators, a plurality of which are normally present in an internal combustion engine. This percentage is generally greater when the lubricating oil circulating in the internal combustion engine is used as the cooling fluid, and especially when the lubricating oil is cold and has a higher viscosity, i.e., before the internal combustion engine has warmed-up. It is desirable to keep power losses due to cooling fluid circulation as low as possible in order to minimize fuel consumption of the internal combustion engine.

SUMMARY OF THE INVENTION

The claimed invention is directed, at least in part, to reducing fuel consumption and engine power losses due to circulating cooling fluid. Accordingly, an adjustable valve arrangement varies the amount of cooling fluid passing through an actuator such that critical component temperatures of the actuator are not exceeded.

The claimed invention is also directed to a procedure for varying the amount of cooling fluid passing through an actuator. In addition to determining whether cooling of an actuator is necessary or not, the amount of cooling fluid passed through the actuator for cooling purposes may be adjusted in such a way that a critical (e.g., a maximum) actuator component temperature is not exceeded. This adjustment is performed by means of a suitable valve arrangement that allows a larger or smaller amount of cooling fluid to flow through the actuator as a function of the temperature of the actuator components.

The present invention provides a method of cooling an electromagnetic actuation device for a valve in an internal combustion engine. The method comprises providing a flow of cooling fluid through the electromagnetic actuation device; and varying the flow of cooling fluid such that a critical component temperature of the electromagnetic actuation device is not exceeded.

The present invention also provides an electromagnetic actuation device for a poppet valve in an internal combustion engine. The device comprises at least one coil winding; an electronic control unit electrically connected to the at least one coil winding; a fluid conduit thermally connected to the at least one coil winding; an adjustable fluid valve in fluid communication with the fluid conduit; and a driver mechanically connected to the fluid valve and electrically connected to the electronic control unit. The electronic control unit energizes the at least one coil winding to displace the poppet valve, the fluid conduit provides cooling fluid to dissipate heat generated by energizing the at least one coil winding, the fluid valve regulates cooling fluid flow through the fluid conduit, and the driver adjusts the fluid valve relative to the heat generated by energizing the at least one coil winding.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention.

DETAILED DESCRIPTION OF THE PREFERRED EMBODIMENT

According to the claimed invention, the amount of cooling fluid that is passed through an actuator is only that which is actually needed to cool the actuator. If, for example, an internal combustion engine having a plurality of valve actuators is still cold, i.e., the internal combustion engine has not yet reached its operating temperature following a cold start, the actuators that are also still cold and do not need cooling. At least in theory, the cooling fluid streams through the actuators can be completely stopped and thereby eliminate engine power loss due to circulating cooling fluid through the actuators. However, when lubricating oil for the internal combustion engine is used as the cooling fluid, a small amount of lubricating oil is generally supplied to continue lubricating the actuators. Therefore, it may not be desirable to completely stop the supply of lubricating oil to the actuators.

Figure 1:
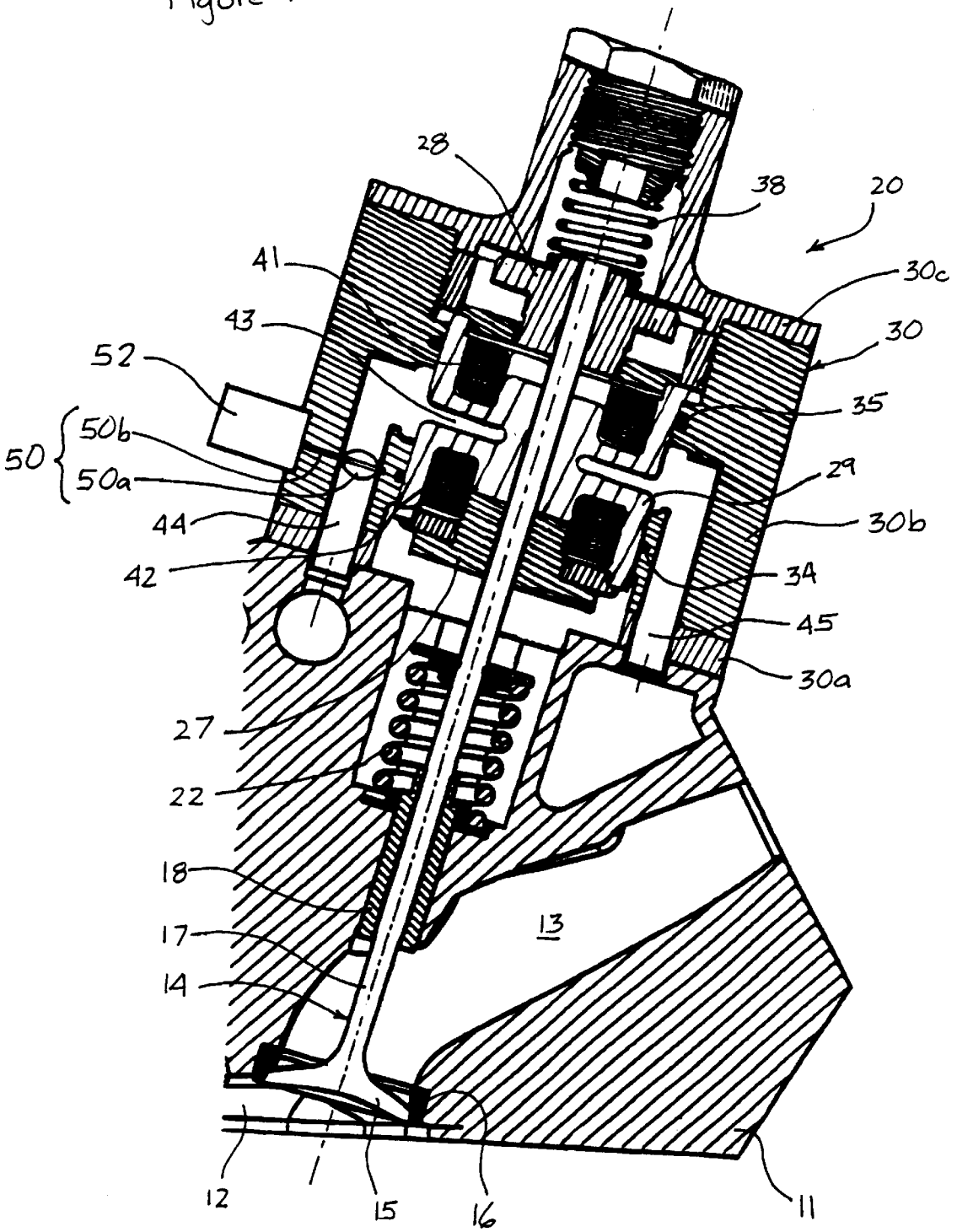
FIG. 1 is a partial cross-section view of an actuator unit according to the present invention.

Referring to FIG. 1, part of a cylinder head 11 is shown in which a combustion chamber 12 is isolated from a duct 13 by a poppet valve 14. In particular, head 15 of valve 14 seats on a valve seat 16 to isolate the chamber 12 from the duct 13. The head 15 is formed integrally with a stem 17 that slidably locates the valve in a valve guide 18. A spring 22 biases the valve 14 to a closed position with respect to the head 11, i.e., with the head 15 contiguously engaging the seat 16.

An actuator 20 displaces the valve 14 between its open and closed positions. The actuator 20 includes a closing armature 27 and an opening armature 28 secured to the valve stem 17. The valve stem 17 and the opening and closing armatures 27,28 are slidably disposed with respect to a solenoid body 29, which is mounted by a valve body 30 to the cylinder head 11. First and second ring seals 34 and 35, respectively, are located between solenoid body 29 and the valve body 30. The valve body 30 may include a base portion 30*a*, a central portion 30*b*, and a cap portion 30*c*. Opening armature 28 is biased with respect to cap portion 30*c* by an opening control spring 38.

The solenoid body 29 has mounted within it an opening coil 41 and a closing coil 42. These coils are electrically connected with an electronic control unit as will be described below.

Solenoid body 29 and valve body 30 define therebetween a generally annular volume 43 into which cooling fluid is fed by a supply line 44 and from which cooling fluid is withdrawn by discharge line 45. This cooling fluid can be pressurized lubricating oil supplied by the engine, or can be coolant that is circulated through the cylinder head 11.

Flow of the cooling fluid is regulated by a valve 50 that is operated by a driver 52. As schematically shown in FIG. 1, valve 50 can include a butterfly plate 50*a* that is rotatable by a shaft 50*b* connected to the driver 52. Rotating the shaft 50*b* causes the butterfly plate 50*a* to move between a first configuration, which significantly or completely limits flow of the cooling fluid through the supply line 44, and a second configuration that minimally limits flow the cooling fluid through the supply line 44. Of course, the valve 50 can be positioned in other locations, e.g., in the discharge line 45, different types of valve mechanisms and drivers, e.g., a gate style valve driven by a solenoid, may be substituted.

The claimed invention is also directed to measuring a temperature of an actuator component by means of a suitable sensor and, based on the output of the sensor, determining (e.g., with an electronic control unit) whether the measured temperature is far below or near a critical maximum actuator component temperature. A larger or smaller amount of cooling fluid is then passed through the actuator based on this determination.

Figure 2:
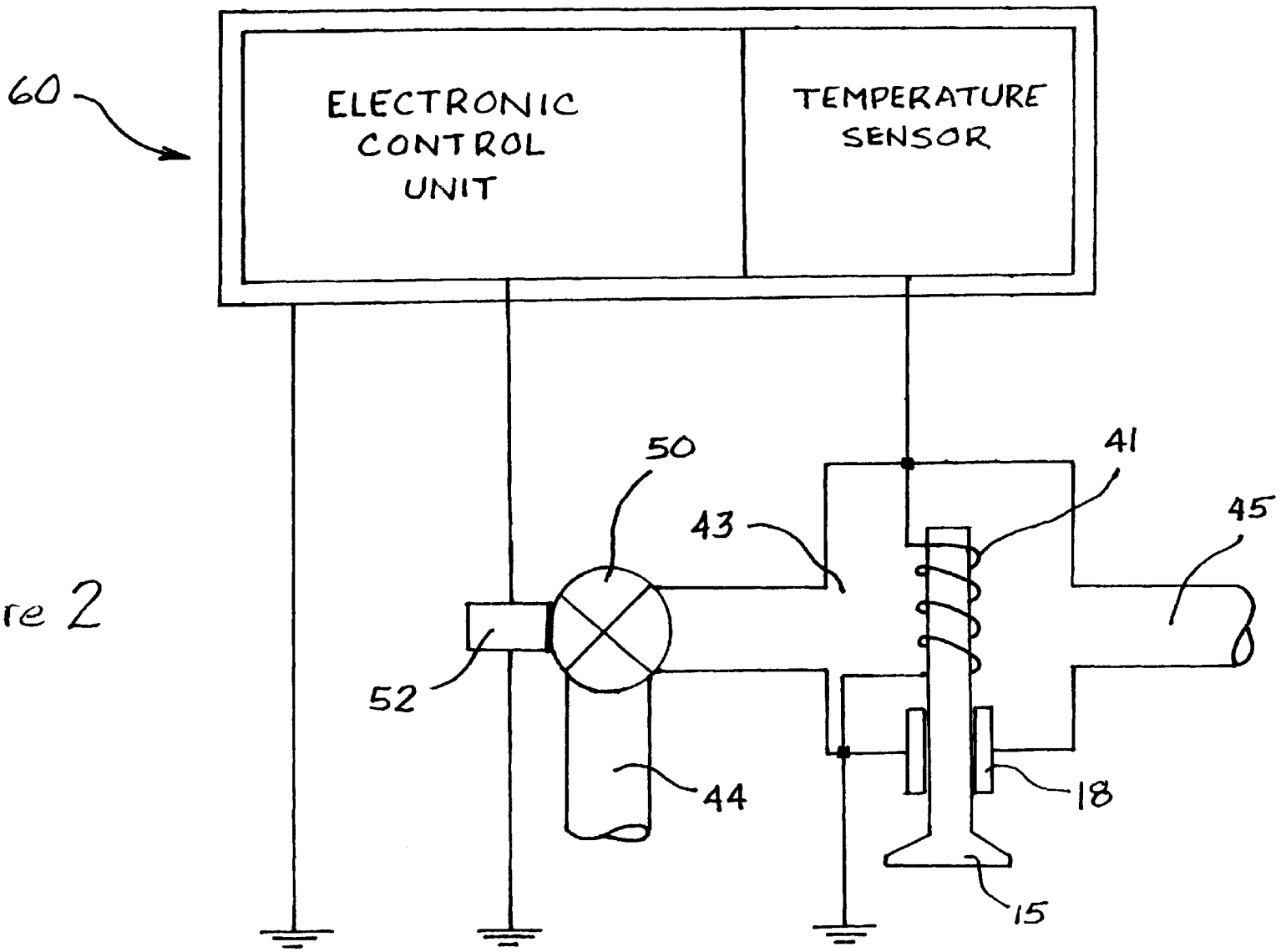
FIG. 2 is a schematic illustration of a system for controlling cooling fluid circulation.

Referring to FIG. 2, an electronic control unit 60 can be electrically connected to the opening and closing coils 41,42 of the actuator 20 for actuating the valve 14. The electronic control unit can also be electrically connected to the driver 52 for adjusting the valve 40. A component temperature of the actuator 20 may be determined, approximately or virtually, in the electronic control unit associated with the actuator. This determination can be made using the electrical current flowing through the coil of the actuator, thereby eliminating the need for an independent temperature sensor. Specifically, when the electrical voltage applied across the coils 41,42 of the electromagnetic actuator 20 and the electrical current flowing through the coils 41,42 are known, the coil resistance, which itself depends significantly on the actuator temperature, can be determined according to well known principles. The magnitude of the electrical resistance of the coil thus represents the component temperature of the actuator and can consequently be compared with a corresponding maximum critical temperature (for the coil resistance).

Thus, generally expressed, an electrical actuator parameter corresponding to the present component temperature can be determined as a function of the electrical current flowing through the coils 41,42 of the actuator 20. The electronic control unit 60 associated with the actuator 20 can compare the determined component temperature with the critical component temperature, or a critical electrical parameter corresponding to this temperature, whereupon the electrical control unit 60 controls the driver 52 to adjust the valve 50, and thereby regulate the amount of cooling fluid required by the actuator 20.

Of course, the electronic control unit 60 can be electrically connected to more than one actuator 20 and to more than one driver 52.

While the present invention has been disclosed with reference to certain preferred embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A method of cooling an electromagnetic actuation device for a valve in an internal combustion engine, the method comprising:

providing a flow of cooling fluid through the electromagnetic actuation device; and varying the flow of cooling fluid such that a critical component temperature of the electromagnetic actuation device is not exceeded.

2. The method according to claim 1, wherein the providing a flow of cooling fluid includes supplying lubricating oil from the internal combustion engine.

3. The method according to claim 1, wherein the providing a flow of cooling fluid includes supplying coolant from the internal combustion engine.

4. The method according to claim 1, wherein the varying the flow of cooling fluid includes providing a valve in the flow of cooling fluid.

5. The method according to claim 1, further comprising:

measuring a temperature of a component of the electromagnetic actuation device; and comparing the measured temperature to a critical component temperature, and accordingly varying the flow of cooling fluid.

6. The method according to claim 5, wherein the measuring includes measuring an electrical parameter of the electromagnetic actuation device that corresponds to a temperature of a component of the electromagnetic actuation device, and the comparing includes comparing the electrical parameter to a critical electrical parameter corresponding to a critical component temperature.

7. The method according to claim 6, wherein the measuring an electrical parameter includes measuring current flow through the electromagnetic actuation device.

8. The method according to claim 7, wherein the providing a flow of cooling fluid includes supplying lubricating oil from the internal combustion engine, and the varying the flow of cooling fluid includes providing a valve in the flow of lubricating oil.

9. An electromagnetic actuation device for a poppet valve in an internal combustion engine, the device comprising:

at least one coil winding;

an electronic control unit electrically connected to the at least one coil winding, the electronic control unit adapted for energizing the at least one coil winding to displace the poppet valve;

a fluid conduit thermally connected to the at least one coil winding, the fluid conduit adapted for providing cooling fluid to dissipate heat generated by energizing the at least one coil winding;

an adjustable fluid valve in fluid communication with the fluid conduit, the fluid valve adapted for regulating cooling fluid flow through the fluid conduit; and a driver mechanically connected to the fluid valve and electrically connected to the electronic control unit, the driver adjusting the fluid valve relative to the heat generated by energizing the at least one coil winding.

10. The device according to claim 9, wherein the fluid valve is in fluid communication with a supply of lubricating oil for the internal combustion engine.

11. The device according to claim 9, wherein the fluid valve is in fluid communication with a supply of coolant for the internal combustion engine.

12. The device according to claim 9, further comprising:

a temperature sensor electrically connected to the electronic control unit, the temperature sensor measuring the heat generated by energizing the at least one coil winding.

13. The device according to claim 12, wherein the temperature sensor measures electrical resistance of the at least one coil winding, the electronic control unit correlates the measured electrical resistance to the heat generated by energizing the at least one coil winding, and the electronic control unit signals the driver to adjust the fluid valve so that a winding temperature due to the heat generated by energizing the at least one coil winding is less than a critical temperature.

14. The device according to claim 13, wherein the fluid valve is in fluid communication with a supply of lubricating oil for the internal combustion engine.

* * * * *